US008251128B2

(12) United States Patent
Hattori et al.

(10) Patent No.: US 8,251,128 B2
(45) Date of Patent: Aug. 28, 2012

(54) METHOD OF PRODUCING COPPER ALLOY WIRE

(75) Inventors: Yoshiaki Hattori, Osaka (JP); Hitoshi Nakamoto, Osaka (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 12/734,144

(22) PCT Filed: Oct. 16, 2008

(86) PCT No.: PCT/JP2008/068763

§ 371 (c)(1), (2), (4) Date: Apr. 14, 2010

(87) PCT Pub. No.: WO2009/051184

PCT Pub. Date: Apr. 23, 2009

(65) Prior Publication Data

US 2010/0206513 A1 Aug. 19, 2010

(30) Foreign Application Priority Data

Oct. 16, 2007 (JP) ..... 2007-269018

(51) Int. Cl.
*B22D 11/06* (2006.01)
*B22D 11/108* (2006.01)
*B22D 11/11* (2006.01)

(52) U.S. Cl. ..... 164/462; 164/473; 164/482; 164/423; 164/433

(58) Field of Classification Search ..... 164/462, 164/482, 433, 423, 473; 75/646
See application file for complete search history.

(56) References Cited

U.S. PATENT DOCUMENTS

2001/0028135 A1* 10/2001 Asao et al. ..... 266/212

FOREIGN PATENT DOCUMENTS

| | | | |
|---|---|---|---|
| JP | 2001-314950 A | | 11/2001 |
| JP | 2006-283181 | * | 10/2006 |
| JP | 2006-283181 A | * | 10/2006 |
| JP | 2006-283181 A | | 10/2006 |
| JP | 2006-341268 A | | 12/2006 |
| WO | WO-2007/015491 A1 | | 2/2007 |

OTHER PUBLICATIONS

International Search Report dated Nov. 18, 2008, issued on PCT/JP2008/068763.

* cited by examiner

*Primary Examiner* — Kevin P Kerns
(74) *Attorney, Agent, or Firm* — Edwards Wildman Palmer LLP; James E. Armstrong, IV; Junko Harada

(57) ABSTRACT

Provided is a method of continuously producing a phosphorus-containing copper alloy wire by adding phosphorus or an element which is less soluble than phosphorus to molten copper. The method includes: adding an element less soluble into a heating furnace for maintaining molten copper sent from a melting furnace at a predetermined high temperature; transferring the molten copper sent from the heating furnace to a tundish; adding phosphorus to the molten copper after decreasing the temperature of the molten copper in the tundish; supplying the molten copper from the tundish to a belt wheel-type continuous casting apparatus; and rolling a cast copper material output from the belt wheel-type continuous casting apparatus, thereby continuously producing a phosphorus-containing copper alloy wire.

1 Claim, 3 Drawing Sheets

METHOD OF PRODUCING COPPER ALLOY WIRE

TECHNICAL FIELD

The present invention relates to a method of producing a copper alloy wire by adding elements less soluble such as iron, and phosphorus to molten copper in a melting furnace, and continuously casting and rolling the molten copper.

Priority is claimed on Japanese Patent Application No. 2007-269018 filed on Oct. 16, 2007, the content of which is incorporated herein by reference.

BACKGROUND ART

The copper alloy wires containing iron and phosphorus have excellent abrasion resistance. Benefits of using the materials for the trolley wires of a railroad includes less frequent replacement of the wire. Therefore, usage of the copper alloy wire containing iron and phosphorus could reduce maintaining cost of the trolley wires.

As a method of producing the copper alloy wires containing iron and phosphorus, Patent Document 1 disclosed a continuous casting method.

In the method, after molten copper is poured out from a shaft furnace where a copper raw material is molten, the molten copper is held in a non-oxidizing atmosphere for certain period of time. Then, oxygen gas and hydrogen gas are removed from the molten copper by a degassing apparatus. A first alloy element is then added to the molten copper while the molten copper is heated by a heating furnace to a high temperature. Thereafter, the molten copper is transferred to a tundish via a trough, and a second alloy element is added to the molten copper in the tundish. By adding iron as the first alloy element and phosphorus as the second alloy element, the copper alloy containing iron and phosphorus can be produced. An ingot is produced by transferring the molten copper from the tundish into a graphite mold, and finally, the copper alloy wires are obtained after applying extrusion processing on the ingot.

As a method of continuously producing a copper alloy wire, Patent Document 2 disclosed a method, in which a belt wheel-type apparatus was used, with integrated casting and rolling processes.

The main part of the continuous casting apparatus with the belt wheel is made of an endless belt which moves circularly and a casting wheel which is rotated by having a part of its circumference to contact with the endless belt. The continuous casting apparatus is connected to a large melting furnace such as a shaft furnace and is also connected to a rolling apparatus. In the configuration, the molten copper output from the melting furnace is continuously cast and rolled, producing a copper wire in the production line at high speed. Therefore, the belt wheel-type continuous casting apparatus can achieve high productivity and enables mass production, reducing production cost of the copper wire consequently.

Patent Document: 1 Japanese Unexamined Patent Application Publication No. 2006-341268

Patent Document 2: Japanese Unexamined Patent Application Publication No. 2001-314950

DISCLOSURE OF INVENTION

Problems to be Solved by the Invention

It is expected that cost reduction can be achieved by continuous casting and rolling the copper alloy wire containing iron and phosphorus disclosed in Patent Document 1 using the belt wheel-type continuous casting apparatus disclosed in Patent Document 2.

In the case where casting is performed using the graphite mold disclosed in Patent Document 1, the ingot with a large cross-section is poured out vertically, while, in the case of the belt wheel-type continuous casting apparatus disclosed in Patent Document 2, the molten copper is bent during casting. Therefore, without an appropriate cast composition, cracks are likely to occur during cooling, when the ingot made in the method disclosed in Patent Document 1 is subjected to the continuous process disclosed in Patent Document 2. In order to avoid cracking, difference between the molten copper temperature and the solidifying temperature of copper need to be reduced. However, there is a limitation to the reduction of the molten copper temperature, since less soluble iron is added to the copper alloy.

The present invention has been made in view of the above situation, an object of which is to enable continuous production of a phosphorus-containing copper alloy wire using a belt wheel-type continuous casting apparatus while melting an element less soluble such as iron, and to achieve cost reduction.

Means for Solving the Problem

According to an aspect of the invention, there is provided a method of continuously producing a phosphorus-containing copper alloy wire by adding phosphorus and an element which is less soluble than phosphorus to molten copper, including: transferring molten copper from a melting furnace to a heating furnace, adding an element less soluble to the molten copper while maintaining the molten copper at a first temperature in the heating furnace, and transferring the molten copper from the heating furnace to a tundish; and adding phosphorus after decreasing the temperature of the molten copper to a second temperature which is lower than the first temperature, supplying the molten copper from the tundish to a belt wheel-type continuous casting apparatus, and rolling the cast copper material output from the belt wheel-type continuous casting apparatus, thereby continuously producing the phosphorus-containing copper alloy wire.

The element less soluble and the phosphorus that can be melted at a lower temperature than the element less soluble, are added separately in the adding process. The element less soluble is melted in advance while maintaining the molten copper transferred from the melting furnace, at a high temperature. The phosphorus is then added after decreasing the temperature of the molten copper. Accordingly, when the molten copper is supplied to the belt wheel-type continuous casting apparatus from the tundish, the temperature of the molten copper is reduced. Therefore, it is possible to appropriately perform casting which is accompanied with bending.

The element less soluble may be made of one or more kinds selected from a group consisting of iron, nickel, cobalt, and chrome.

In the producing method according to the aspect of the invention, a copper mass may be added to the molten copper in order to decrease the temperature of the molten copper.

In addition, the first temperature of the molten copper at the time of adding the element less soluble may be equal to or higher than 1150° C., and the second temperature of the molten copper at the time of adding the phosphorus may be equal to or lower than 1130° C. In addition, the first temperature of the molten copper at the time of adding the element less soluble may be equal to or higher than 1170° C., and the second temperature of the molten copper at the time of adding phosphorus may be equal to or lower than 1120° C.

Advantageous Effects of the Invention

According to the aspect of the invention, the element less soluble is added to the molten copper from the melting furnace while maintaining the molten copper at a high temperature in the heating furnace, so that the element less soluble can be kept melted. In addition, the molten copper is supplied to the belt wheel-type continuous casting apparatus after decreasing the temperature of the high-temperature molten copper, so that casting that is accompanied with bending can be appropriately performed by the belt wheel-type continuous casting apparatus, thereby preventing the occurrence of cracks.

DESCRIPTION OF THE REFERENCE SYMBOLS

Figure 1:
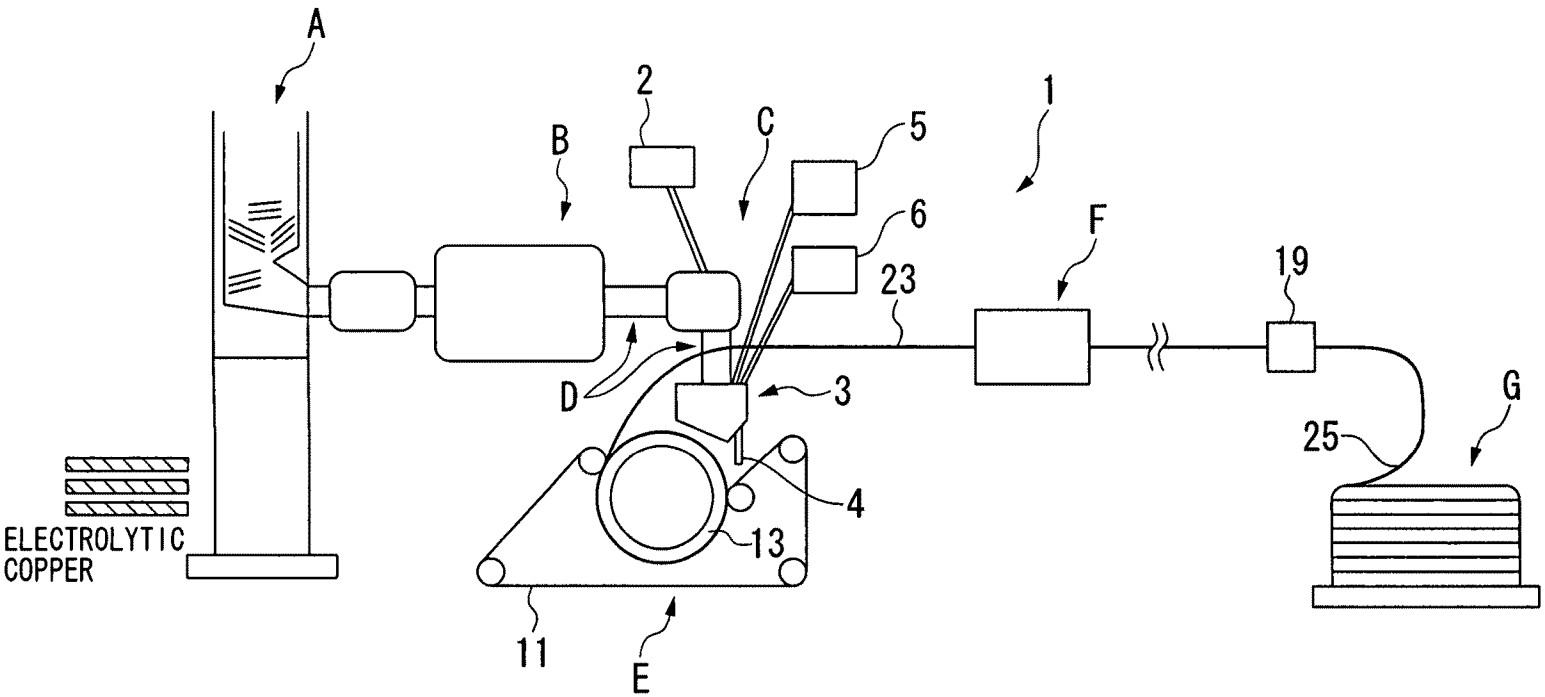
FIG. 1 is a diagram schematically illustrating a configuration of a producing apparatus used for a method of producing a copper alloy wire according to an embodiment of the invention.

1: PRODUCING APPARATUS OF COPPER ALLOY WIRE
2: FIRST ADDING MEANS
3: TUNDISH
4: POURING NOZZLE
5: MOLTEN COPPER COOLING MEANS
6: PHOSPHORUS ADDING MEANS
11: ENDLESS BELT
13: CASTING WHEEL
A: MELTING FURNACE
B: HOLDING FURNACE
C: HEATING FURNACE
D: CASTING TROUGH
E: BELT WHEEL-TYPE CONTINUOUS CASTING APPARATUS
F: ROLLING APPARATUS
G: COILER

BEST MODE FOR CARRYING OUT THE INVENTION

Hereinafter, a method of producing a phosphorus-containing copper alloy wire according to an embodiment of the invention will be described with reference to the accompanying drawings.

First, a producing apparatus will be described.

Main parts of a producing apparatus 1 of a copper alloy according to this embodiment includes a melting furnace A, a holding furnace B, a heating furnace C, a casting trough D, and a belt wheel-type continuous casting apparatus E, a rolling apparatus F, and a coiler G.

As the melting furnace A, for example, a shaft furnace having a cylindrical furnace main body is suitably used. At a lower portion of the melting furnace A, a plurality of burners (not shown) is provided along a circumferential direction in multiple stages in a vertical direction. In the melting furnace A, combustion occurs in a reducing atmosphere, thereby producing a so-called oxygen-free molten cooper. The reducing atmosphere can be obtained by increasing the fuel ratio of, for example, a gas mixture of natural gas and air.

The holding furnace B is used for temporarily holding the molten copper output from the melting furnace A and controlling the amount of the molten copper supplied to a downstream side at a constant level. The holding furnace B includes a heating means such as a burner to prevent the temperature of the held molten copper from decreasing. In addition, the inside of the furnace is kept in a reducing atmosphere by increasing a fuel ratio of the burner.

As the heating furnace C, for example, a small-scale electric furnace is used. The heating furnace C heats the molten copper supplied via the holding furnace B to a predetermined high temperature and sends the supplied molten copper to the casting trough D in a high-temperature state.

In addition, the heating furnace C is provided a first adding means 2 for adding an element less soluble such as iron, to the high-temperature molten copper in the heating furnace C. The element less soluble such as iron, to be added is, for example, in a granular form.

The casting trough D connects the holding furnace B to the heating furnace C, and the heating furnace C to a tundish 3, for sealing the molten copper in a non-oxidizing atmosphere and performing degassing thereon to transfer the molten copper to the tundish 3. The non-oxidizing atmosphere is formed by blowing, for example, a gas mixture of nitrogen and carbon monoxide or a noble gas such as argon as an inert gas into the casting trough D. For the degassing, a plurality of weirs (not shown) are provided in the casting trough D, and a number of balls or powder made of carbon (not shown) are provided between the weirs in suspension. The degassing is performed by agitating the molten copper by the weirs. The balls or powder made of carbon can effectively capture oxygen in the molten copper and discharging it as carbon monoxide.

The tundish 3 is provided with a pouring nozzle 4 at an end in the flow direction of the molten copper such that the molten copper is supplied from the tundish 3 to the belt wheel-type continuous casting apparatus E. In addition, the tundish 3 is provided with a molten copper cooling means 5 and a phosphorus adding means 6. The molten copper cooling means 5 is used for adding copper masses as a cooling material into the molten copper to decrease the molten copper temperature due to the heat of melting of the copper masses. The phosphorus adding means 6 is used for adding phosphorus into the molten copper which is at a lowered temperature due to the adding of the copper masses.

Positions of the molten copper cooling means 5 and the phosphorus adding means 6 are not limited to the tundish 3. However, in order to add phosphorus to the molten copper which is subjected to deoxidization and dehydrogenation so as to avoid chemical reactions between phosphorus and oxygen as much as possible, it is preferable that the positions are provided between an end portion of the casting trough D which passes a degassing means and an end of the tundish 3.

The belt wheel-type continuous casting apparatus E includes an endless belt 11 which moves circularly and a casting wheel 13 which is rotated by allowing a part of the circumference thereof to come in contact with the endless belt 11. The belt wheel-type continuous casting apparatus E is also connected to the rolling apparatus F.

The rolling apparatus F performs rolling on a cast base wire material 23 output from the belt wheel-type continuous casting apparatus E. The rolling apparatus F is connected to the coiler G via a flaw detector 19.

Next, a method of producing a phosphorus-containing copper alloy wire using the producing apparatus of a phosphorus-containing copper alloy wire configured as described above will be described.

First, a copper raw material such as electrolytic copper is charged into the melting furnace A, and the copper raw material is melted by combustion of the burner, thereby obtaining molten copper. Here, the melting furnace A is set up in a reducing atmosphere to produce molten copper in a low-oxygen state.

The molten copper obtained in the melting furnace A is transferred in a state where the molten copper is controlled at a constant flow rate by being temporarily held by the holding furnace B and supplied to the heating furnace C. The molten copper is, for example, at a temperature equal to or lower than 1100° C. immediately after the melting furnace A due to the burner and is maintained at a high temperature (first temperature) of, for example, 1150 to 1240° C. in the heating furnace C. The first temperature is more preferably in the range of 1190 to 1210° C.

In addition, iron (Fe) is added to the heating furnace C. In this case, in the molten copper at, for example, 1100° C. as it is output from the melting furnace A and the holding furnace B, the added iron is not completely melted and is more likely to remain as unmelted iron. However, since the molten copper in the heating furnace C is maintained at a sufficiently high temperature, even the less soluble iron in a solid state can be completely melted. As the iron, for example, metal iron in a granular form is used.

In order to melt the iron, a method of adding a Cu—Fe alloy may be used. However, the alloy is expensive as an additive, which is not preferable.

Next, the molten copper is sent from the heating furnace C via the casting trough D. Since the casting trough D is set up in a non-oxidizing atmosphere and is provided with the weirs (not shown), the molten copper is agitated while flowing to be degassed. The degassing is performed to prevent oxides formed from Fe or Sn or the like from being incorporated into the molten copper, and to make an oxygen concentration of the molten copper to be finally 10 ppm.

The degassed molten copper is sent to the tundish 3, and the copper masses are input to the tundish 3 as the cooling material and phosphorus is added thereto by the molten copper cooling means 5 and the phosphorus adding means 6, respectively. As the copper mass, for example, in a case of a casting speed of 23 t/hour, a mass with a volume of 1 to 150 $mm^3$ is input at 150 kg/hour. By inputting the copper mass, the molten copper temperature is decreased to a second temperature lower than the first temperature, for example, to a temperature of 1085 to 1130° C. The second temperature is more preferably in the range of 1090 to 1110° C.

In addition, phosphorus is added to the temperature-decreased molten copper. As the phosphorus as an additive, a copper base alloy (15% P base alloy) containing 15 wt % of phosphorus (P) is used. The molten copper temperature had been decreased to be in the range of 1085 to 1130° C. at the time of adding phosphorus since, when the molten copper temperature is higher than 1130° C., a coarse columnar crystal is grown and cracks or flaws are more likely to occur in the cast base wire material 23.

In addition, if the molten copper sent from the melting furnace A is supplied without passing through the heating furnace C, phosphorus can be added to the molten copper at a relatively low temperature. However, in this case, the less soluble iron in the solid state is not melted but remains as unmelted iron, which is not preferable. Therefore, in order to melt the iron, temperature of the melted copper is increased once, and after the iron in the solid state is completely melted, the temperature of the molten copper is decreased to add phosphorus.

The molten copper added with iron and phosphorus as described above is injected to the belt wheel-type continuous casting apparatus E from the tundish 3 so as to be continuously cast, and when the cast product is output from the belt wheel-type continuous casting apparatus E, it is molded into the cast base wire material 23. The cast base wire material 23 is rolled by the rolling apparatus F to be produced as a phosphorus-containing copper alloy base material 25, existence of flaw of the copper alloy base material 25 is detected by the flaw detector 19, and the copper alloy base material is coiled by the coiler G while a lubricating oil such as wax is applied thereto.

In this producing method, the iron in the solid state is completely melted, and a phosphorus-containing copper alloy base material 25 with good quality and no cracks or the like can be produced. In addition, the phosphorus-containing copper alloy base material 25 is subjected to a solution treatment, an aging treatment, and a peeling treatment and is then drawn into a trolley wire having a groove.

For example, it is possible to obtain a phosphorus-containing copper alloy wire made of 0.080 to 0.500 wt % of Sn, 0.001 to 0.300 wt % of Fe, 0.001 to 0.100 wt % of P, and the rest including Cu and inevitable impurities. Particularly, it is preferable that the trolley wire be made of 0.100 to 0.150 wt % of Sn, 0.080 to 0.120 wt % of Fe, 0.025 to 0.040 wt % of P, and the rest including Cu and inevitable impurities and a ratio of Fe/P ranging from 2.5 to 3.2.

EXAMPLE 1

The influence of the temperature of molten copper at the time of adding phosphorus into a tundish on crack occurrence was studied by experimentation.

Figure 2A:
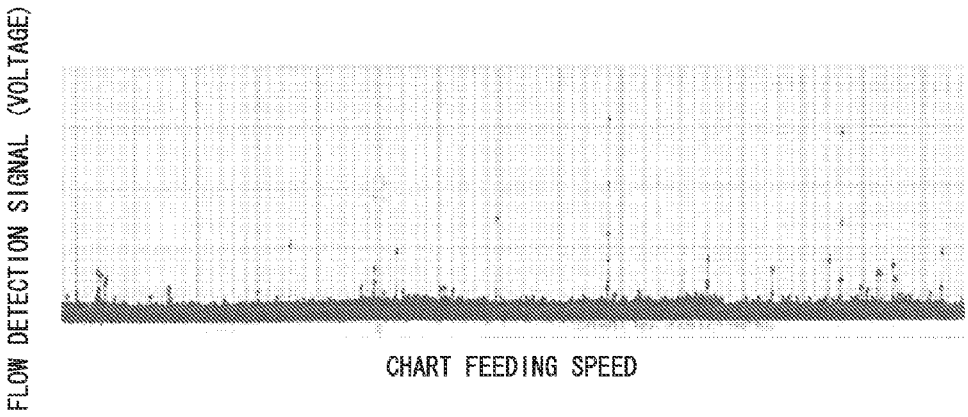
FIG. 2A is a chart showing a result of eddy-current flaw detection of the embodiment of Example 1.

As a copper mass as a cooling material, an oxygen-free copper ball for plating having a diameter of 11 mm was used. Copper masses were added at a rate of, for example, 200 pieces/hour while the molten copper temperature was monitored and the data being used to adjust the rate. The molten copper temperature was 1120° C. The molten copper was rolled via a rolling apparatus while the molten copper was continuously cast by a belt wheel-type continuous casting apparatus, thereby producing a rough-drawn copper alloy wire having a diameter of 18 mm. The copper alloy wire was a copper alloy made of 0.118 wt % of Sn, 0.090 wt % of Fe, and 0.031 wt % of P, and the balance including Cu and inevitable impurities. In this case, the ratio of Fe/P was about 2.9. The oxygen (O) concentration was 8 ppm. A chart showing the flaw detection results from an eddy-current flaw detector of the copper alloy wire is shown in FIG. 2A.

Figure 2B:
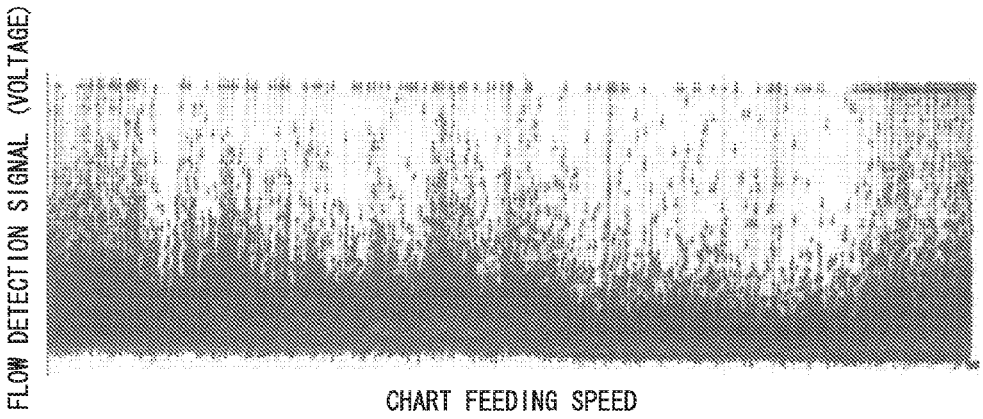
FIG. 2B is a chart showing a result of eddy-current flaw detection of the comparative example of Example 1.

When the addition of the cooling material in the tundish was limited, the molten copper temperature became 1140° C., and in this case, a copper alloy made of 0.118 wt % of Sn, 0.078 wt % of Fe, and 0.031 wt % of P, and the balance including Cu and inevitable impurities was obtained. The oxygen (O) concentration was 6 ppm. A chart showing the flow detection results of the copper alloy wire is shown in FIG. 2B.

In the case of the former example, about 4000 kg of the copper alloy wire was produced, and one small flaw to an extent which does not have an effect on the product and two intermediate flaws were discovered, and there were no large flaws constituting a product defect. On the contrary, in the case of the latter comparative example, about 2800 kg of the copper alloy wire was produced, and too many large flaws were discovered by the flaw detector to be counted by the detector.

EXAMPLE 2

Next, a copper alloy wire (a so-called HRS alloy) made of 1550 ppm of Co, 310 ppm of Ni, 280 ppm of Zn, 380 ppm of Sn, and 470 ppm of P, and the balance including Cu and inevitable impurities was produced by continuous casting with the above-described belt wheel-type continuous casting apparatus and rolled via the rolling apparatus. The oxygen (O) concentration was 6 ppm.

Figure 3A:
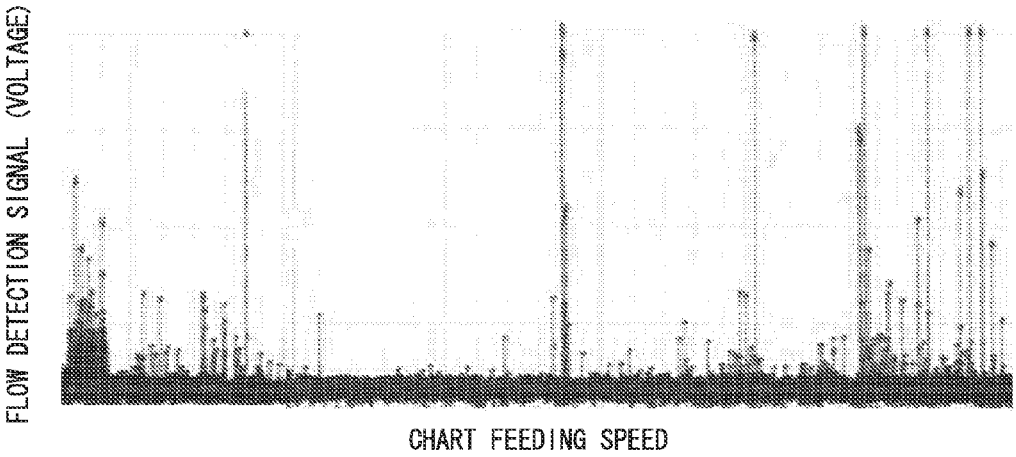
FIG. 3A is a chart showing a result of eddy-current flaw detection of the embodiment of Example 2.

Copper masses were added into the tundish as a cooling material at a rate of, for example, 200 pieces/hour. The tundish temperature was set to 1115° C. and, while the molten copper temperature was monitored and the data being used to adjust the rate. FIG. 3A shows the flaw detection results with the eddy-current flaw detector of the copper alloy wire produced under these conditions.

Figure 3B:
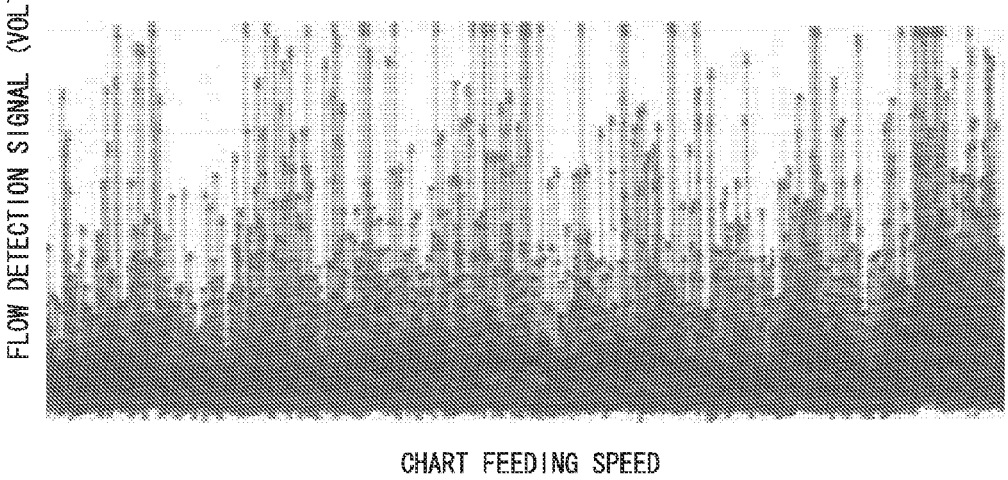
FIG. 3B is a chart showing a result of eddy-current flaw detection of the comparative example of Example 2.

When the addition of the cooling material in the tundish was limited, the molten copper temperature became 1140° C. FIG. 3B shows the flaw detection results from the eddy-current flaw detector of the copper alloy wire produced under these conditions.

In the case of the example in which the tundish temperature was set to 1115° C., about 4000 kg of the copper alloy wire was produced, and 19 small flaws which do not have an effect on the product and 12 intermediate flaws were discovered, and there were 6 large flaws that may be defects of a product. On the contrary, in the case of the comparative example in which the tundish temperature was set to 1140° C., about 4000 kg of the copper alloy wire was produced, and uncountable large number of small and intermediate flaws were discovered, with 45 large flaws.

In addition, the present invention shall not be limited to the above embodiment but may be modified in various ways within a scope not departing from the gist of the present invention. For example, the cooling material input into the tundish may be a copper ball made of phosphorus-containing deoxidized copper and cooling of the molten copper and adding of phosphorus may be performed simultaneously. Furthermore, the phosphorus-containing copper alloy wire produced by the producing method of the invention may be applied to, wires other than trolley wire, such as, for example, a wire for a vehicle having a diameter of, for example, 8 to 30 mm.

Although, the configuration in which the copper base alloy (15% P base alloy) was added by the phosphorus adding means provided in the tundish was described, the invention is not limited thereto. Elements other than phosphorus may be added by using the phosphorus adding means. Alternatively, other than the phosphorus adding means, a second adding means may be provided in the tundish to add other elements.

EXAMPLE 3

A copper alloy wire made of 0.118 wt % of Sn, 0.090 wt % of Fe, and 0.031 wt % of P, and the balance including Cu and inevitable impurities was produced by continuous casting with the above-described belt wheel-type continuous casting apparatus and rolled via the rolling apparatus. The oxygen (O) concentration was 8 ppm.

First, the molten copper obtained by the melting furnace was temporarily held by the holding furnace. The held molten copper was supplied to the heating furnace while the molten copper was controlled at a constant flow rate. A predetermined amount of iron (Fe) was added while the temperature of the heating furnace was maintained at 1200° C. The molten copper to which iron (Fe) had been added was transferred to the tundish via the casting trough. Here, in order to cool the molten copper, a cooling material was added. As a copper mass as the cooling material, an oxygen-free copper ball for plating having a diameter of 11 mm was used, and the copper masses were added at a rate of, for example, 220 pieces/hour while the molten copper temperature was monitored and the data being used to adjust the rate. The molten copper temperature was 1100° C. Here, predetermined amount of phosphorus (P) and tin (Sn) were added to the molten copper, and the molten copper was continuously cast by the belt wheel-type continuous casting apparatus and rolled via the rolling apparatus so as to produce a rough-drawn copper alloy wire having a diameter of 18 mm.

Flaws on the surface of the wire were measured using the eddy-current flaw detector. In the case of this example, about 4000 kg of the copper alloy wire was produced. There were no small flaws. One intermediate flaw, which has an effect on the product, was discovered. No large flaws, which constitute a product defect, were not discovered. In addition, when a cross-section of the copper alloy wire was observed using a metallographical microscope at 500×, no unsolved iron (Fe) was detected.

The invention claimed is:

1. A method of continuously producing a phosphorus-containing copper alloy wire by adding phosphorus and an element which is less soluble than phosphorus to molten copper, the method comprising the steps of:

transferring molten copper through a casting trough from a melting furnace to a heating furnace, in which the molten copper is maintained at a first temperature;

adding an element, which is less soluble than phosphorus, to the molten copper in the heating furnace after the step of transferring molten copper through the casting trough from the melting furnace to the heating furnace;

transferring the molten copper through the casting trough from the heating furnace to a tundish after the step of adding an element, which is less soluble than phosphorus;

decreasing the temperature of the molten copper in the tundish to a second temperature which is lower than the first temperature by adding solid copper mass to the molten copper in the tundish after the step of transferring the molten copper through the casting trough from the heating furnace to the tundish;

adding phosphorus to the molten copper in the tundish after the step of decreasing the temperature;

producing a cast copper material by supplying the molten copper from the tundish to a belt wheel-type continuous casting apparatus after the step of adding the phosphorus; and rolling the cast copper material output from the belt wheel-type continuous casting apparatus, thereby continuously producing the phosphorus-containing copper alloy wire, wherein the first temperature of the molten copper at the step of adding the element less soluble is equal to or higher than 1150° C., and the second temperature of the molten copper at the step of adding the phosphorus is equal to or lower than 1130° C.

* * * * *